US011715909B2

(12) United States Patent
Zhao et al.

(10) Patent No.: US 11,715,909 B2
(45) Date of Patent: Aug. 1, 2023

(54) CARD EDGE CONNECTOR WITH IMPROVED GROUNDING/SHIELDING PLATE

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Zhi-Bin Zhao, Kunshan (CN); Wen-Jun Tang, Kunshan (CN); Xi-Xiang Gu, Kunshan (CN); Hung-Chi Yu, New Taipei (TW); Ming-Kun Ye, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 30 days.

(21) Appl. No.: 17/367,592

(22) Filed: Jul. 5, 2021

(65) Prior Publication Data

US 2022/0006242 A1 Jan. 6, 2022

(30) Foreign Application Priority Data

Jul. 3, 2020 (CN) ..... 202010634900.7
Jul. 3, 2020 (CN) ..... 202010634905.X
(Continued)

(51) Int. Cl.
*H01R 13/64* (2006.01)
*H01R 13/6471* (2011.01)
(Continued)

(52) U.S. Cl.
CPC ..... *H01R 13/6471* (2013.01); *H01R 13/516* (2013.01); *H01R 13/6586* (2013.01); *H01R 13/6597* (2013.01)

(58) Field of Classification Search
CPC ..... H01R 13/6471; H01R 13/516; H01R 13/6586; H01R 13/6597; H01R 12/727; H01R 13/6594
See application file for complete search history.

(56) References Cited

U.S. PATENT DOCUMENTS 4,975,084 A * 12/1990 Fedder ..... H01R 13/6585 439/108
5,035,631 A * 7/1991 Piorunneck ..... H01R 12/721 439/60
(Continued)

FOREIGN PATENT DOCUMENTS

CN 1229293 A 9/1999
CN 101453088 A 6/2009
(Continued)

*Primary Examiner* — Truc T Nguyen
(74) *Attorney, Agent, or Firm* — Ming Chieh Chang

(57) ABSTRACT

A card edge connector includes an insulative housing defining a front face, a rear face, and a card slot opening forward through the front face, a row of first terminals retained in the insulative housing from the front face, a row of second terminals retained in the insulative housing from the rear face, and a grounding and shielding plate. The row of second terminals includes signal terminals and grounding terminals, each second terminal including an upright portion, an elastic portion extending from the upright portion with a contacting portion exposed upon the card slot, and a leg portion. The grounding and shielding plate covers the rear face of the insulative housing and electrical connects to all the grounding terminals of the row of second terminals.

4 Claims, 35 Drawing Sheets

(30) Foreign Application Priority Data

Jul. 3, 2020 (CN) ..... 202010634911.5
Jul. 3, 2020 (CN) ..... 202021283063.X

(51) Int. Cl.
*H01R 13/516* (2006.01)
*H01R 13/6597* (2011.01)
*H01R 13/6586* (2011.01)

(56) References Cited

U.S. PATENT DOCUMENTS 5,664,968 A * 9/1997 Mickievicz ..... H01R 13/6582 439/607.1
5,980,272 A * 11/1999 McHugh ..... H01R 12/7005 439/79
8,221,139 B2 7/2012 Jie et al.
8,540,525 B2 9/2013 Kent et al.
8,764,460 B2 7/2014 Rutger et al.
8,764,464 B2 7/2014 Jonathan et al.
2016/0172792 A1* 6/2016 Horning ..... H01R 13/6585 439/607.07
2020/0076135 A1* 3/2020 Tang ..... H01R 12/724
2022/0302652 A1* 9/2022 Patel ..... H01R 13/6585

FOREIGN PATENT DOCUMENTS

CN 201773988 U 3/2011
CN 103811907 A 5/2014
CN 104810648 A 7/2015
CN 107591655 A 1/2018
CN 107658593 A 2/2018
CN 207559188 U 6/2018
CN 207572652 U 7/2018
CN 108832338 A 11/2018
CN 109742606 A 5/2019
CN 208904327 U 5/2019
CN 208955231 U 6/2019
CN 209183805 U 7/2019
CN 110867681 A 3/2020
JP 2006301873 * 11/2006 ..... H01R 31/06

* cited by examiner

CARD EDGE CONNECTOR WITH IMPROVED GROUNDING/SHIELDING PLATE

BACKGROUND OF THE INVENTION

1. Field of the Invention

The present invention relates to a card edge connector with improved grounding/shielding plate.

2. Description of Related Arts

China Patent 210628555 discloses an electrical connector which includes an insulative housing with a card slot and two support members. The electrical connector is simple in structure, small in occupied space and easy to assemble, but it may not meet high speed requirement.

Therefore, an improved card edge connector is desired.

SUMMARY OF THE INVENTION

A card edge connector comprises an insulative housing defining a front face and a rear face and a card slot opening forward through the front face, a row of first terminals retained in the insulative housing from the front face, a row of second terminals retained in the insulative housing from the rear face, and a grounding and shielding plate. The row of second terminals comprises signal terminals and grounding terminals, each second terminal including an upright portion, an elastic portion extending from the upright portion with a contacting portion exposed upon the card slot, and a leg portion. The grounding and shielding plate covers the rear face of the insulative housing and electrically connects to all the grounding terminals of the row of second terminals.

Other objects, advantages and novel features of the present invention will become more apparent from the following detailed description of the present embodiment when taken in conjunction with the accompanying drawings.

DETAILED DESCRIPTION OF THE PREFERRED EMBODIMENTS

FIGS. 1 through 6 illustrate a card edge connector 100 of a first embodiment, which is adapted for M.2 module or card (not shown) based on PCI-EXPRESS architecture. In this embodiment, the connector 100 has a high profile, which is mounted on a printed circuit board (PCB) 900.

Figure 1:
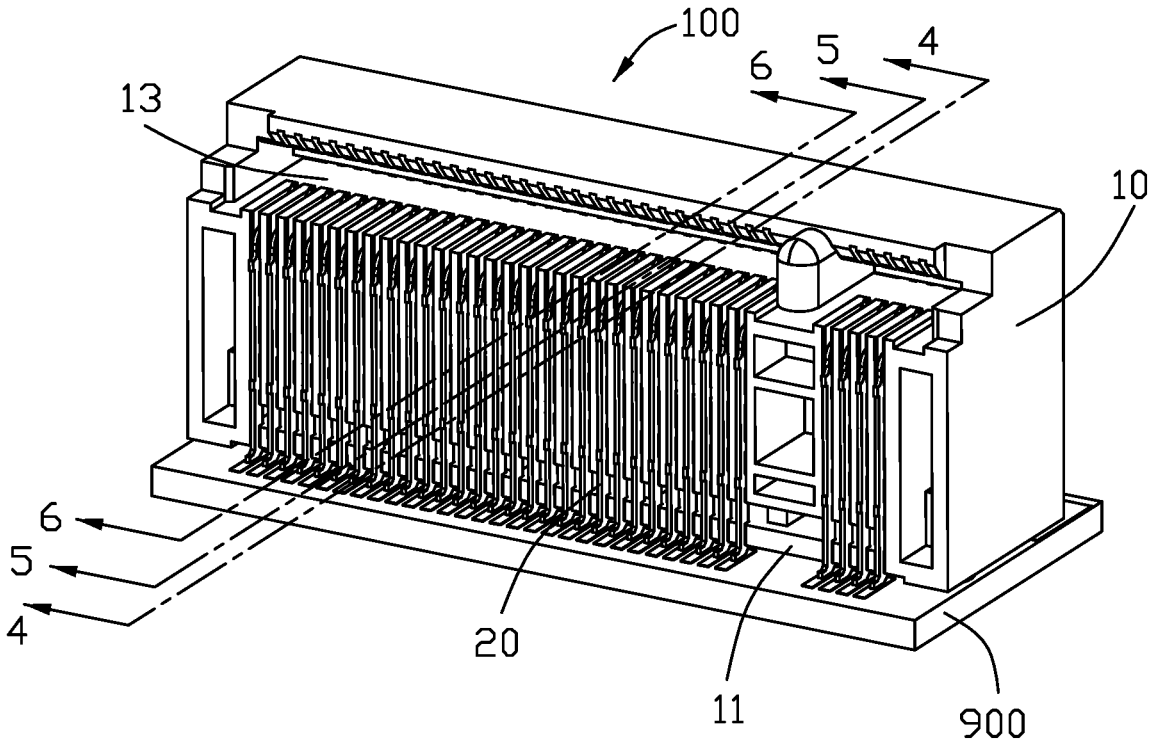
FIG. 1 is a perspective view of a card edge connector of a first embodiment in accordance with the present invention.
Figure 2:
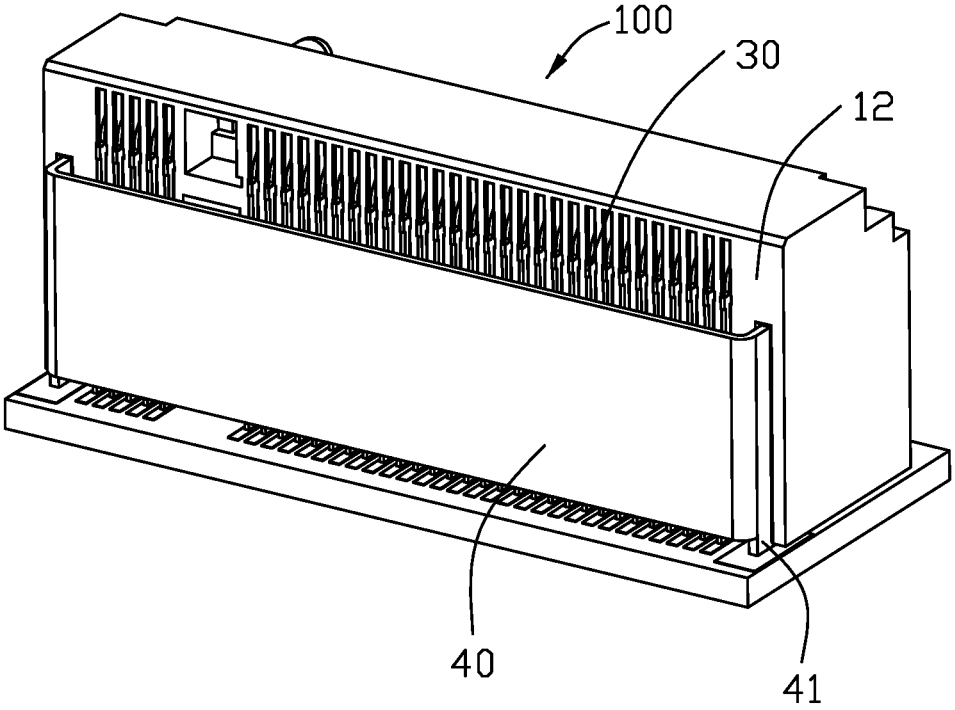
FIG. 2 is another perspective view of the card edge connector.
Figure 3:
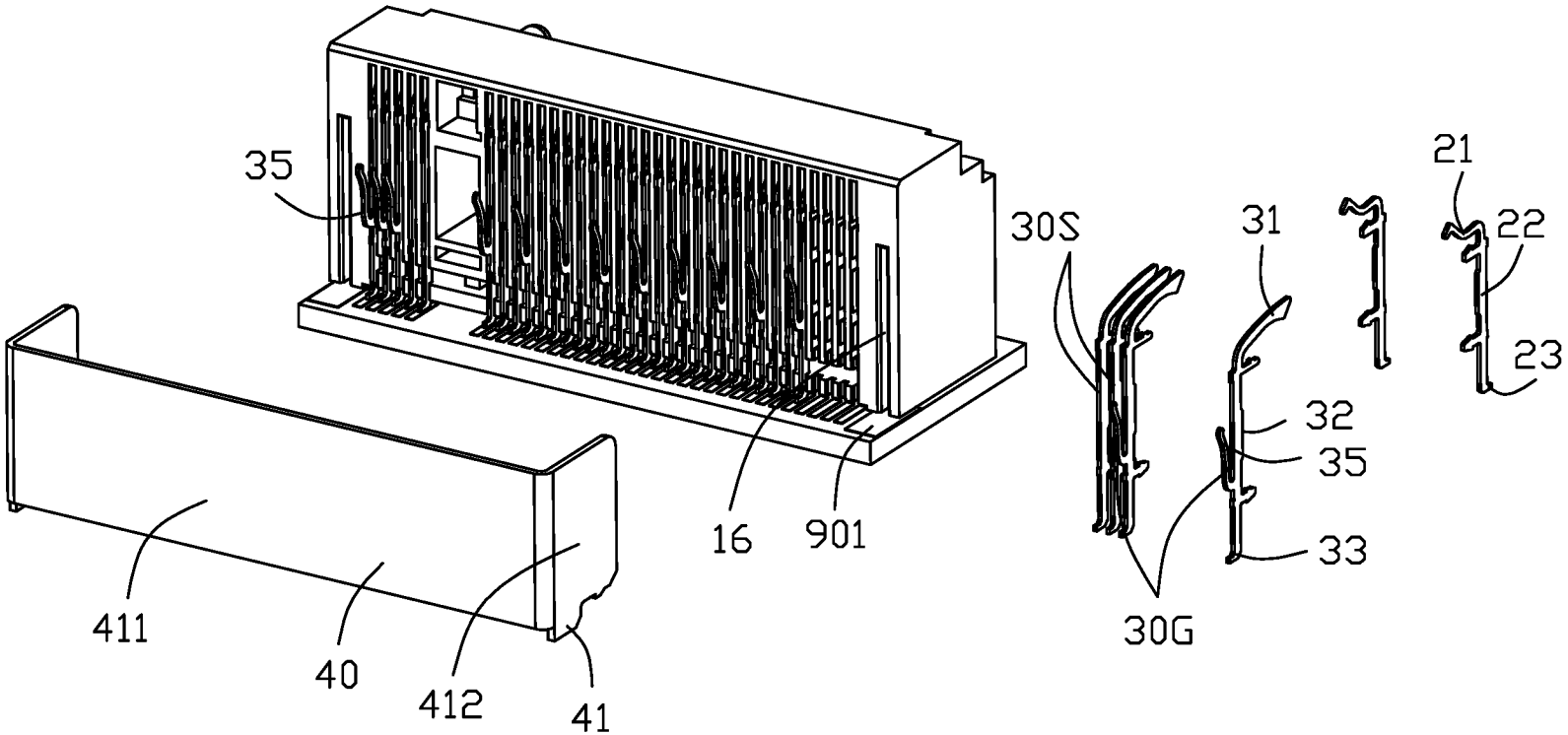
FIG. 3 is an exploded perspective view of the card edge connector.

Referring to FIGS. 1-3, the connector 100 includes an insulating housing 10, a row of first terminals 20, a row of second terminals 30 and a grounding plate 40. The housing 10 defines a front face 11 confronting with an insertion of the module and a rear face 12 opposite to the front face 11, and a card slot 13 opening forward from the front face 11. In conjunction with FIG. 4, the top wall above the card slot 133 is located behind the lower wall below the card slot 11, so the card can inserted into the card slot 13 in a slantwise pattern.

Figure 4:
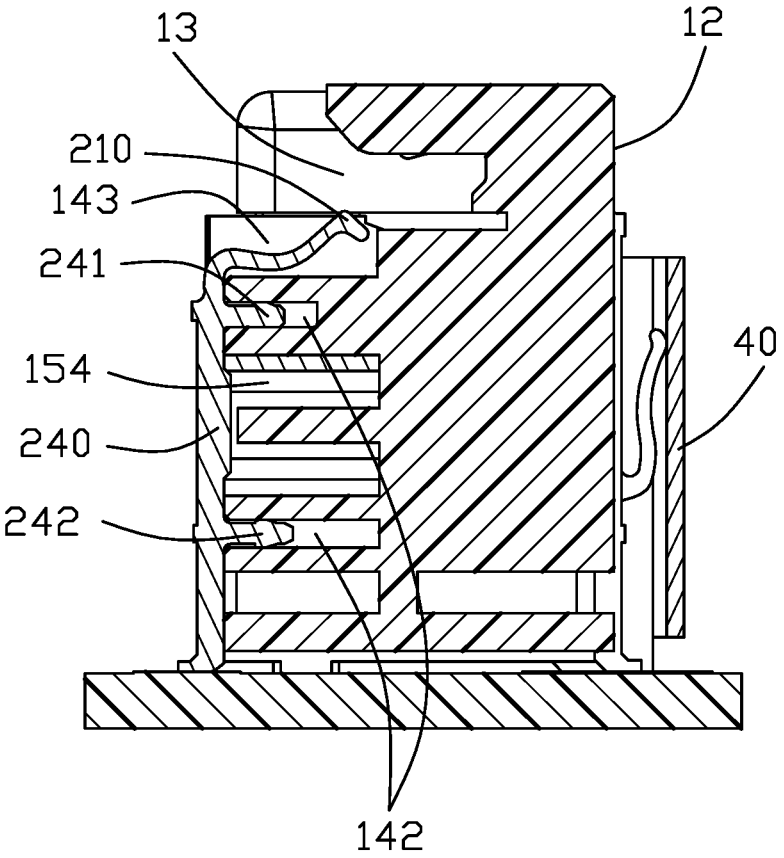
FIG. 4 is a cross-sectional view of the card edge connector taken along line 4-4 in FIG. 1.

In conjunction with FIG. 4, the row of first terminals 20 is inserted rearward into the housing 10 from the front face 11, each first terminal 20 includes a retaining portion 22, an elastic portion 21 from the retaining portion with a contacting portion 210 extending into the card slot 13 and a leg portion 23 extending from the retaining portion. The retaining portions 22 are retained in the housing near to the front face 11. The retaining portion 13 has an upright portion 240, a first/upper rib 241 and a second/lower rib 242 extending rearwards from the upright portion 240, the first and second ribs 241, 241 are inferenced with the housing 10. The first rib 241 is disposed at a joint of the retaining portion 22 and the elastic portion 21, the second rib 242 is near to the leg portion 23. The passageway includes an upright part (not labeled) receiving the upright portion 240, two retaining part 142 extending rearward from the upright part and receiving the first and second ribs, and a communicating portion 143 above the top of the upright part and communicating with the card slot 13 to receive the elastic portion 21, the elastic portion 21 can shift in the communicating portion 143.

Figure 5:
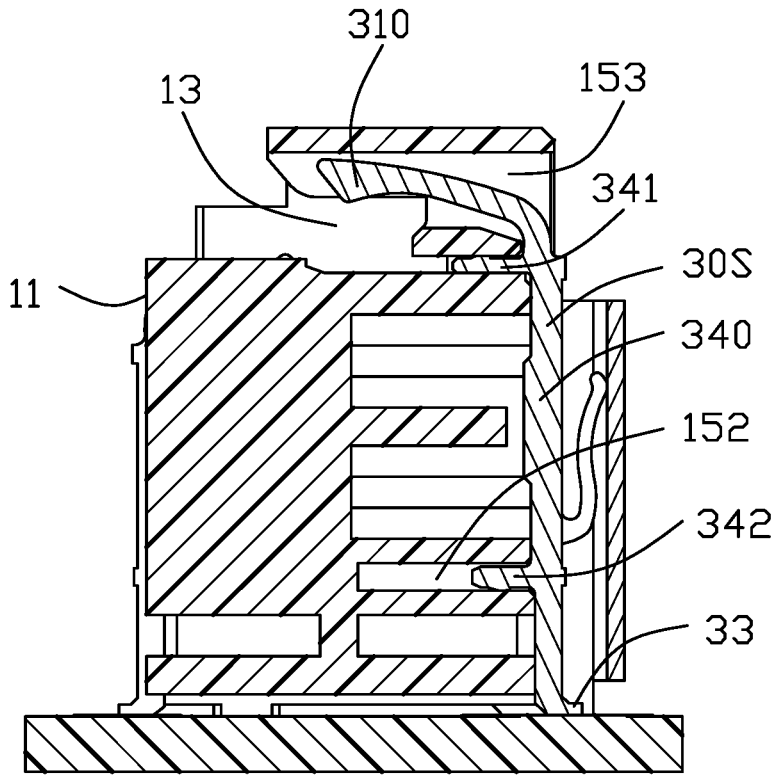
FIG. 5 is a cross-sectional view of the card edge connector taken along line 5-5 in FIG. 1
Figure 6:
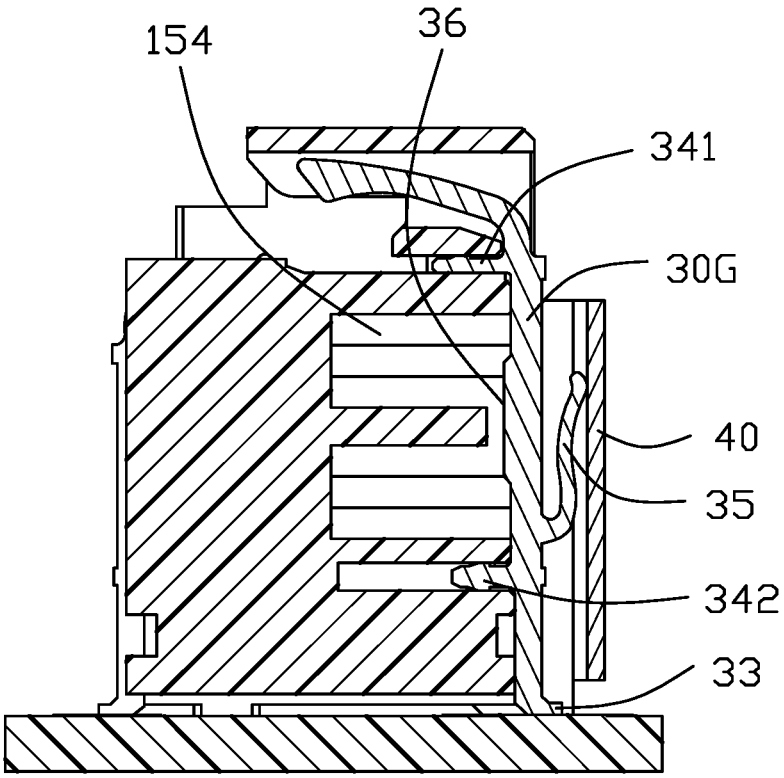
FIG. 6 is a cross-sectional view of the card edge connector taken along line 6-6 in FIG. 1.
Figure 7:
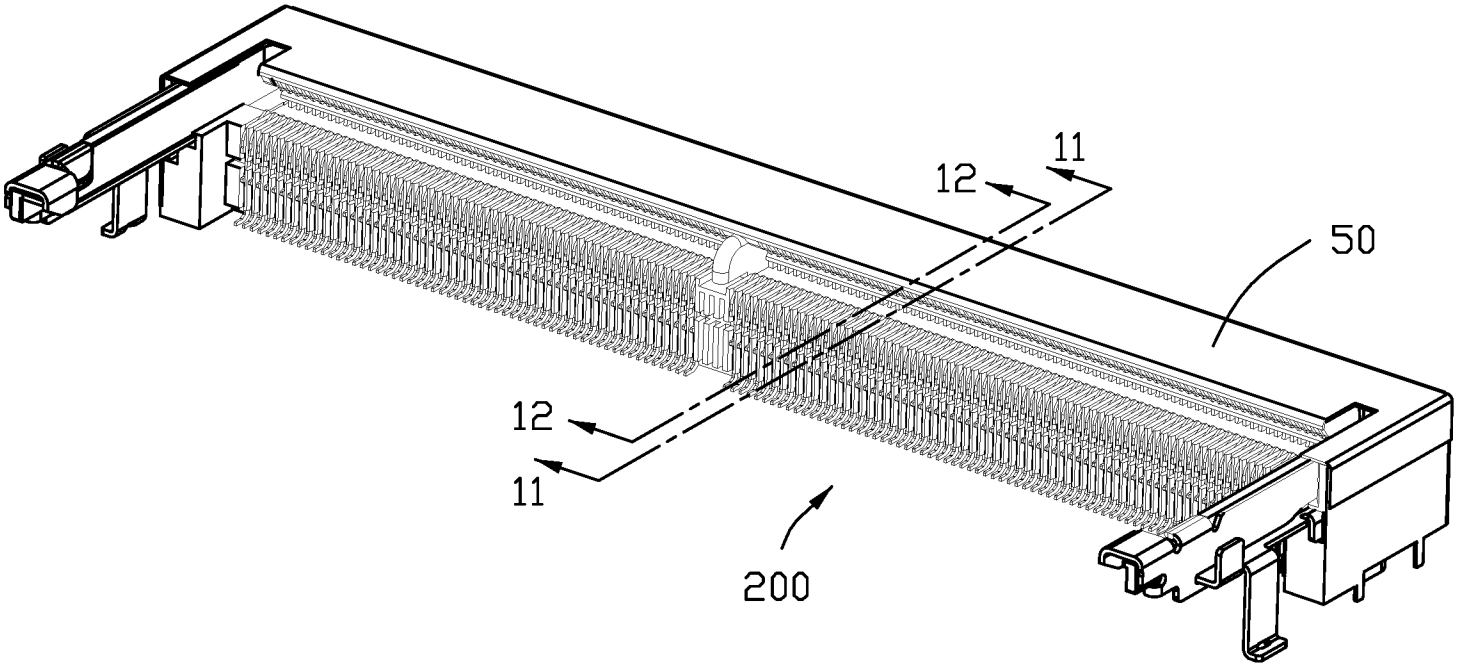
FIG. 7 is a perspective view of a card edge connector of a second first embodiment in accordance with the present invention.
Figure 8:
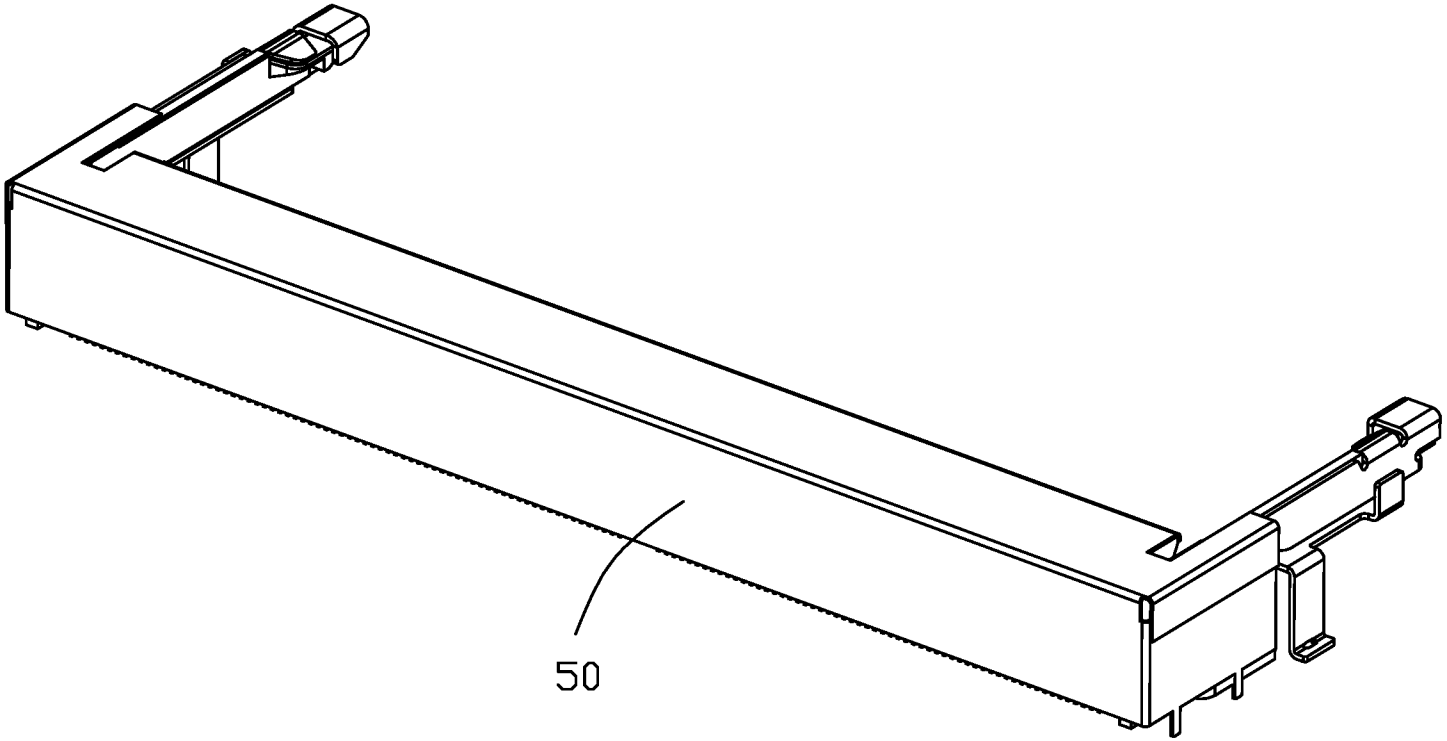
FIG. 8 is another perspective view of the card edge connector.
Figure 9:
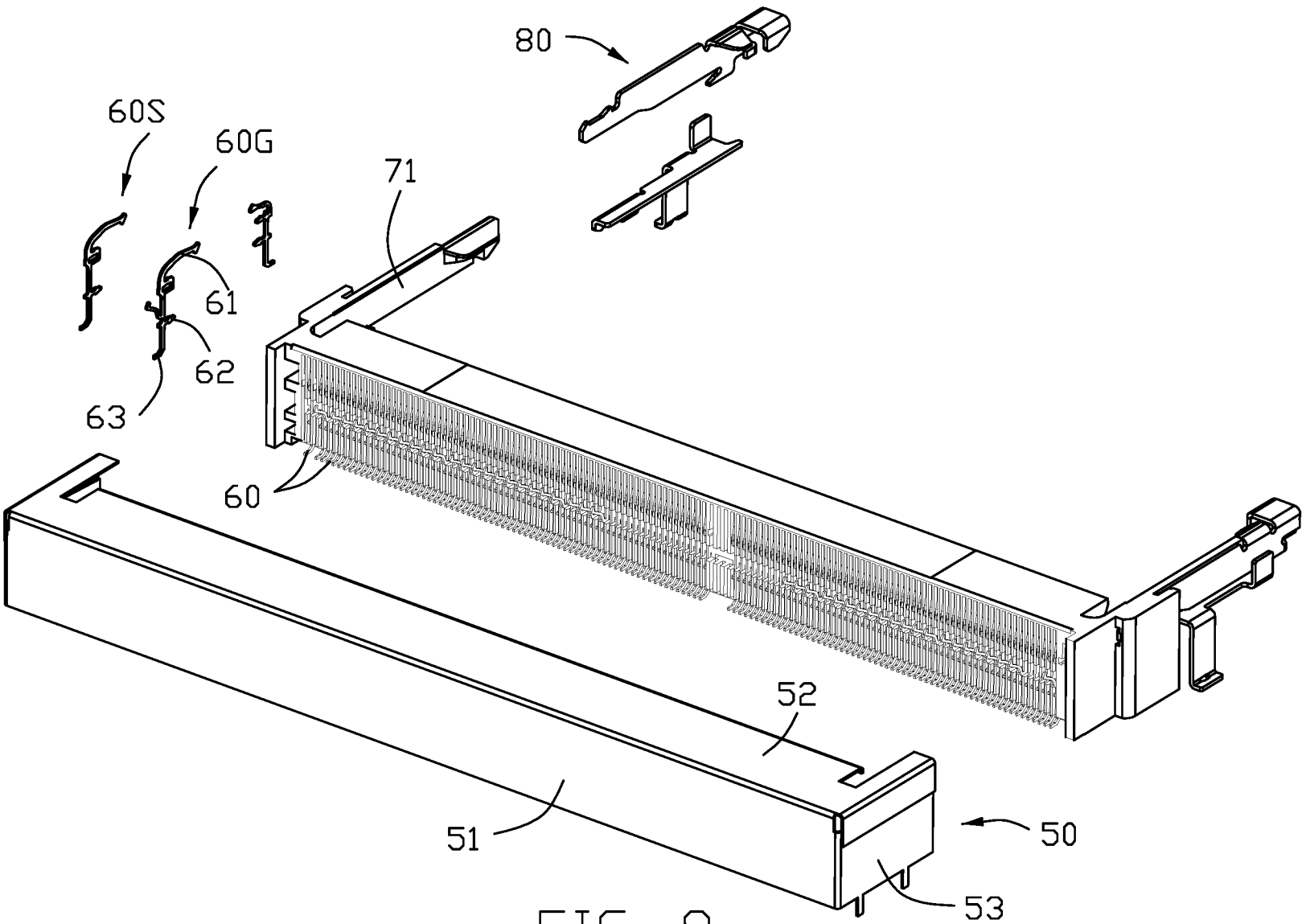
FIG. 9 is an exploded perspective view of the card edge connector.
Figure 10:
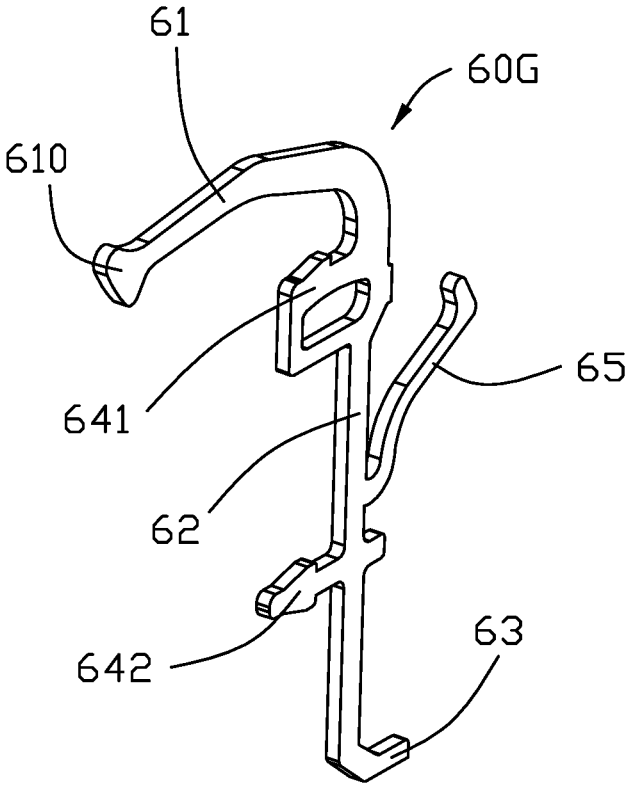
FIG. 10 is a perspective view of the second terminal.
Figure 11:
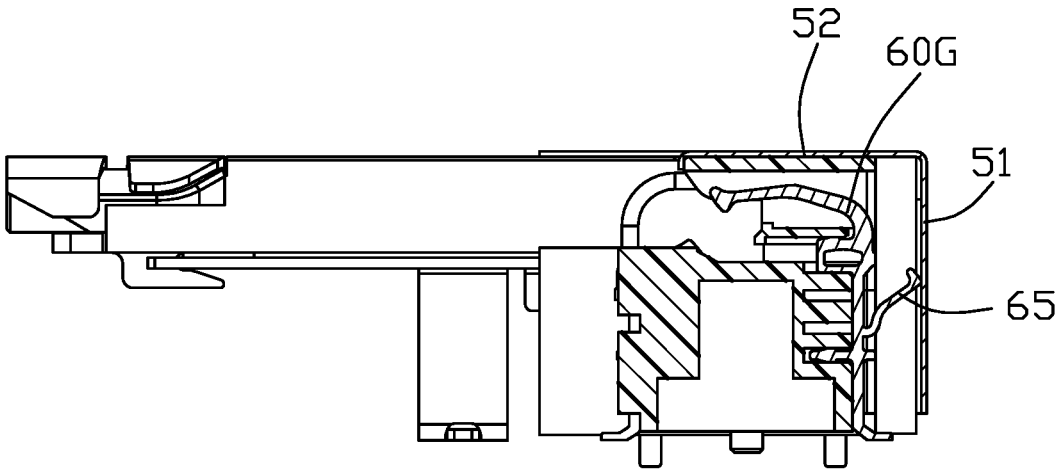
FIG. 11 is a cross-sectional view of the card edge connector taken along line 11-11 in FIG. 7.
Figure 12:
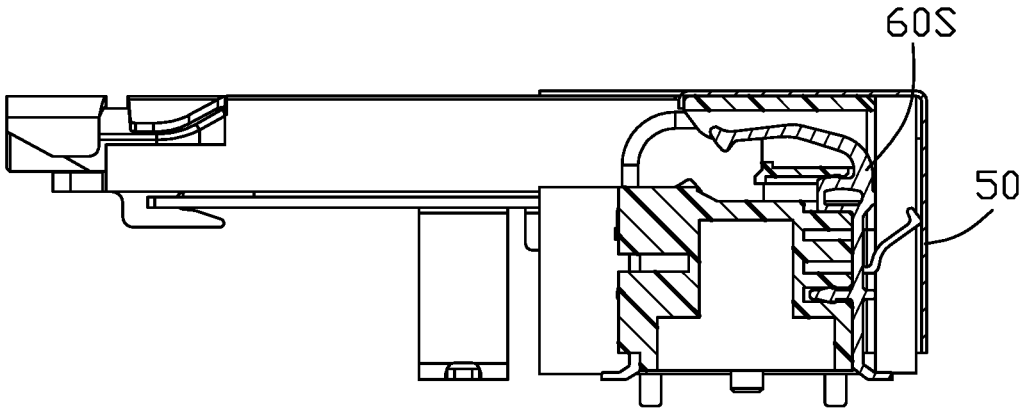
FIG. 12 is a cross-sectional view of the card edge connector taken along line 12-12 in FIG. 7.

In conjunction with FIGS. 5 and 6, the row of second terminals 40 is forwards inserted to the housing from the rear face 12. Each terminal 40 includes a retaining portion 32, an elastic portion 31 extending from the retaining portion with a contacting portion 310 extending in the card slot 13 and a leg portion 33. The retaining portions includes an upright portion 340, and a first/upper rib 341 and a second/lower rib 342, the first rib 341 is disposed at a joint of the upright portion 340 and the elastic portion 31, the second rib 342 is near to the leg portion 33. The passageway includes an upright part (not labeled) receiving the upright portion 340, two retaining parts 152 extending rearward from the upright part and receiving the first and second ribs 341, 342 and a communicating portion 153 above the top of the upright part and communicating with the card slot 13 and receiving the elastic portion 31, the elastic portion 31 can shift in the communicating part 153. A space passageway 154 is disposed between the retaining parts, which benefit to the manufacture of the insulating housing.

In conjunction with FIGS. 5 and 6, the row of second terminals 30 includes signal terminals 30S and grounding terminals 30G, the two types of terminals have a same construct except that each grounding terminal 30G further defines a grounding finger 35, which slants upward from the upright portion 340. Each second terminal 30 is punched from a metal plate, the arrangement direction of the row of second terminals 30 are perpendicular to the metal plate. The retaining portion 32 is upright, and the first and second ribs 341, 342 extend from a front edge of the retaining portion/upright portion, while the grounding finger 35 extend from a rear edge of the retaining portion/upright portion. The grounding fingers 35 are located between the first rib 341 and the second rib 342. The carrier-cutting faces 36 of terminals are at the front edge of the upright portion 340 and located between the first ribs and the second ribs.

The grounding plate 40 is a one-piece metal plate, which has a main plate 411 covering the whole rear face of the insulative housing and two bending plates 412 retained in the retaining slot 16 defined on the insulative housing 10, so the row of second terminals 30 are shielding from a rear direction, i.e., the grounding plate 40 is kind of a type of a shielding plate. The upper edge of the grounding plate 40 is near to the first rib 341, the lower edge of the grounding plate 40 is near to the leg portion 32. The leg portions 33 bend rearwards and extend beyond the rear face 12. A distance between the grounding plate 40 and the rear face is provided, thereby the grounding finger 35 can deform in the space.

The grounding fingers 35 press against the grounding plate 40, thereby establishing an electrical connection between the grounding terminals 30 and grounding plate 40. All the grounding terminals 30G of the row of second terminals 30 are connected together, resulting in lower resonance and improving the performance of insertion loss and return loss and cross-talking. Two grounding legs 41 extend from a lower edge of the grounding plate 40 and are soldered with the grounding pads 901 on the PCB 900.

FIGS. 7 through 12 illustrating a card edge connector 200 of a second embodiment adapted for DDR SO-DIMM Module or card which transmit different signal from the M.2 card. The two connectors 100, 200 has a similar construct and the improvement of those two embodiments is that a ground plate is added and contacts all the grounding terminals in a same row, so as to improve the performance of insertion loss and return loss and cross talk. The grounding plate shields all the terminals to improve Electro Magnetic Interference, EMI. Therefore, description on the connector 200 is given below, focusing the main features.

Referring to FIGS. 7 through 12, the card edge connector 200 includes an insulative housing 70, a row of first terminals (not labeled) and a row of second terminals 60 retained in housing near to the rear face, and a pair of latching members 80, and a shielding shell 50 surrounding the insulative housing 70. A pair of arms 71 extends from two opposite ends of the insulative housing and the latching members 80 are retained on the arms 71, respectively. The SO-DIMM card is inserted in the connector 200 and latched and retained by the latching members 80. The shielding shell 50 includes a top plate 52, a rear plate 51 and two end plates 53 covering corresponding faces of the housing 70, to shield the connector 200. The row of second terminals 60 includes signal terminals 60S and grounding terminals 60G, each second terminal includes an elastic portion 61 with contacting portion 610, a leg portion 63 and a retaining portion 62. A first rib 641 and a second rib 642 extend forwards from the retaining portion, the first rib 641 is of a frame shape with a central opening, which make the first rib has a better deforming performance. Other ribs also could have such construction. The grounding terminals 60G of the second terminals 60 also includes ground fingers 65 extending from the rear edges of the retaining portions/upright portion. The grounding finger 35 slants upwards and touch the rear or main plate 51 for establish an electrical connection between the grounding terminals 60G and the shielding shell 50. The rear plate 51 left a distance from the leg portions 63 and joint with the top plate 52 to surround the whole rear face of the housing.

Figure 13:
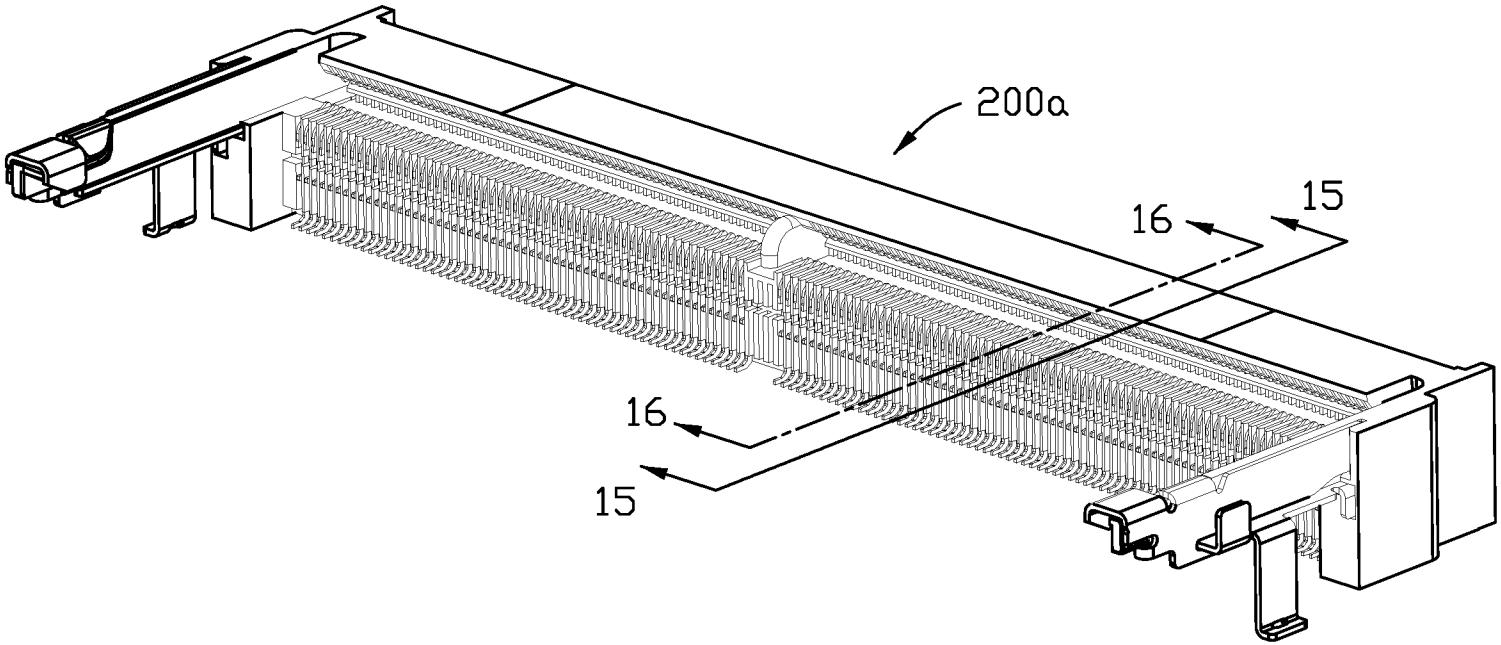
FIG. 13 is a perspective view of a card edge connector of a third embodiment in accordance with the present invention.
Figure 14:
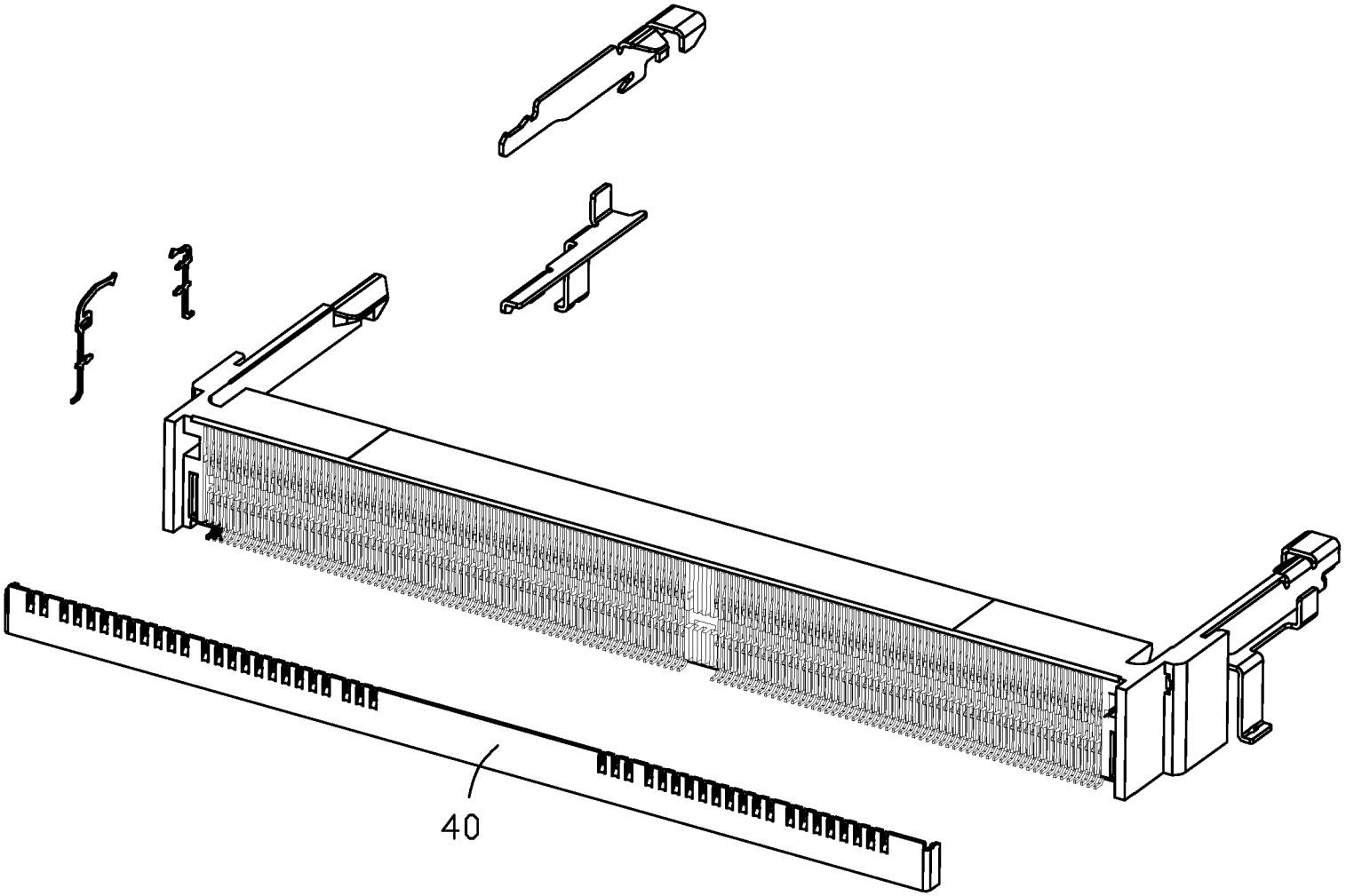
FIG. 14 is an exploded view of the card edge connector.
Figure 15:
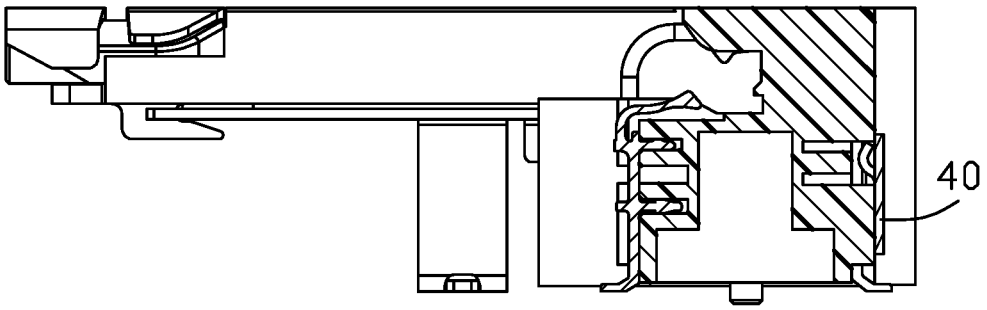
FIG. 15 is a cross-sectional view of the card edge connector taken along line 15-15 in FIG. 13.
Figure 16:
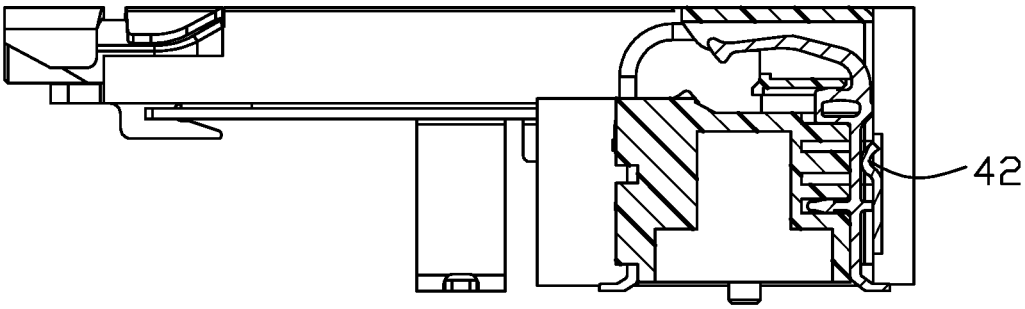
FIG. 16 is a cross-sectional view of the card edge connector taken along line 16-16 in FIG. 13.
Figure 17:
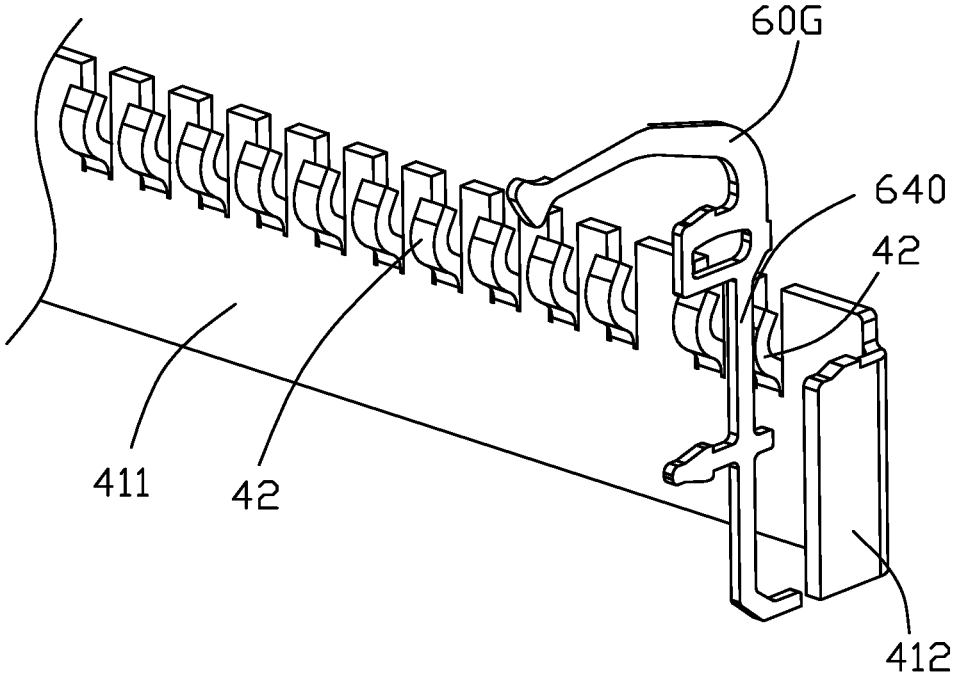
FIG. 17 is a perspective view of the second terminal and the grounding plate.
Figure 18:
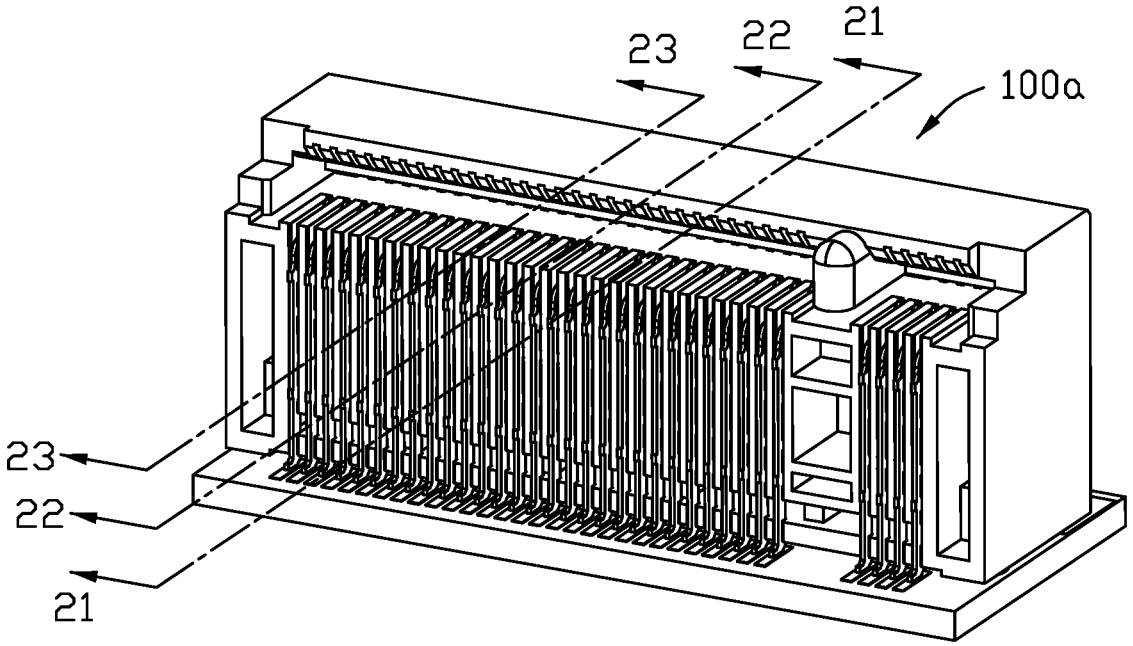
FIG. 18 is a perspective view of a card edge connector of fourth embodiment in accordance with the present invention.
Figure 19:
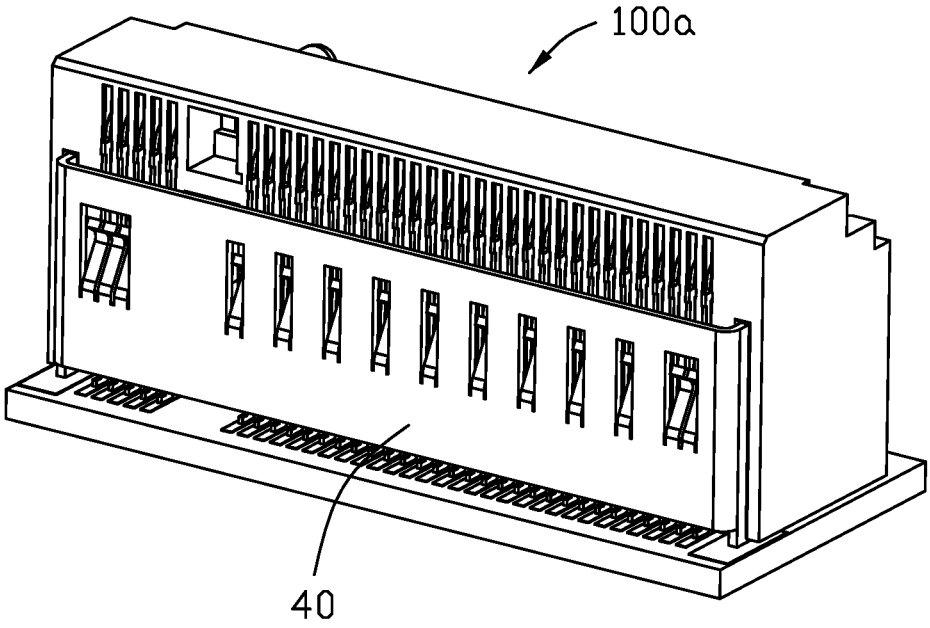
FIG. 19 is another perspective view of the card edge connector.
Figure 20:
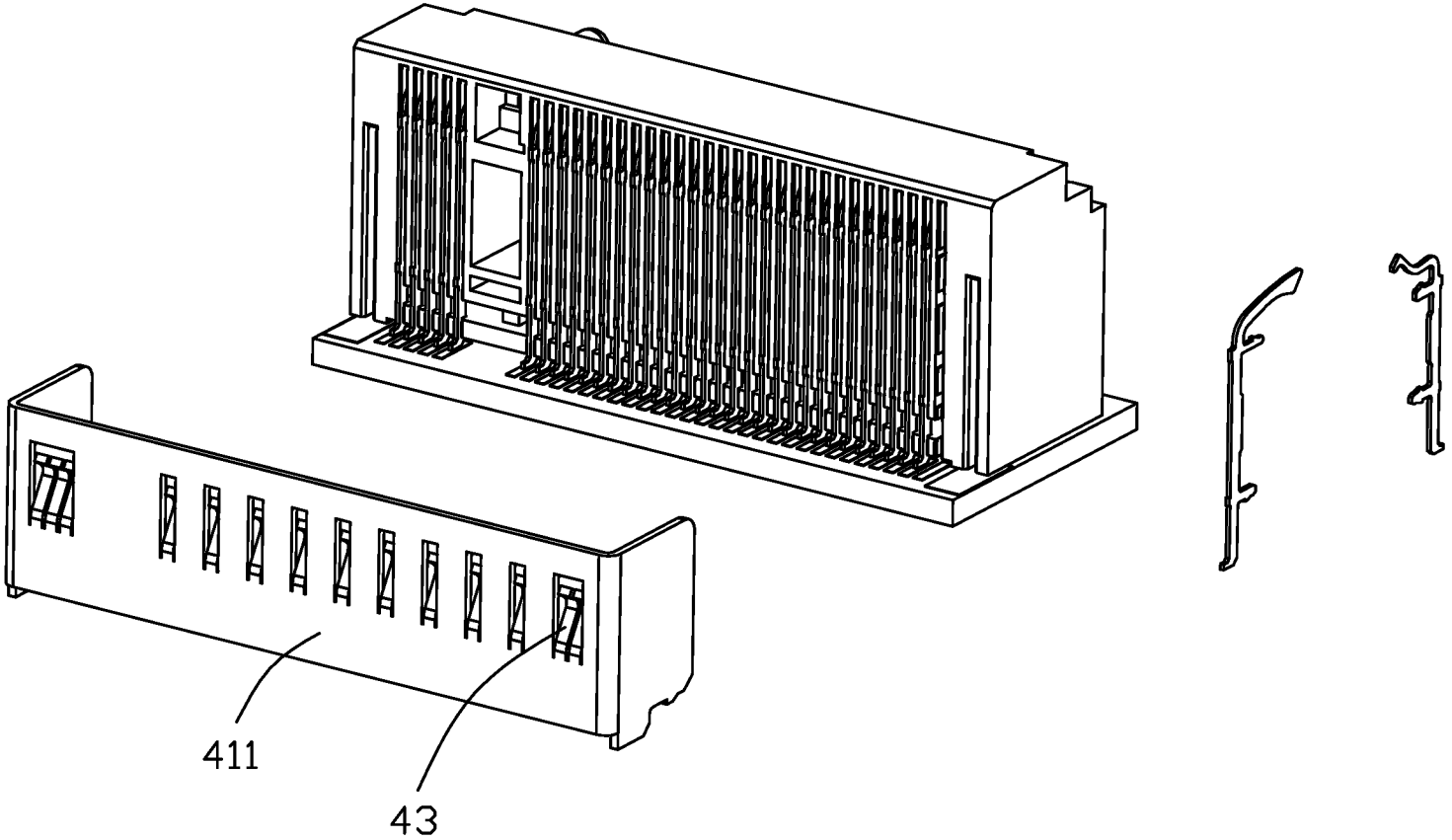
FIG. 20 is an exploded perspective view of the card edge connector.
Figure 21:
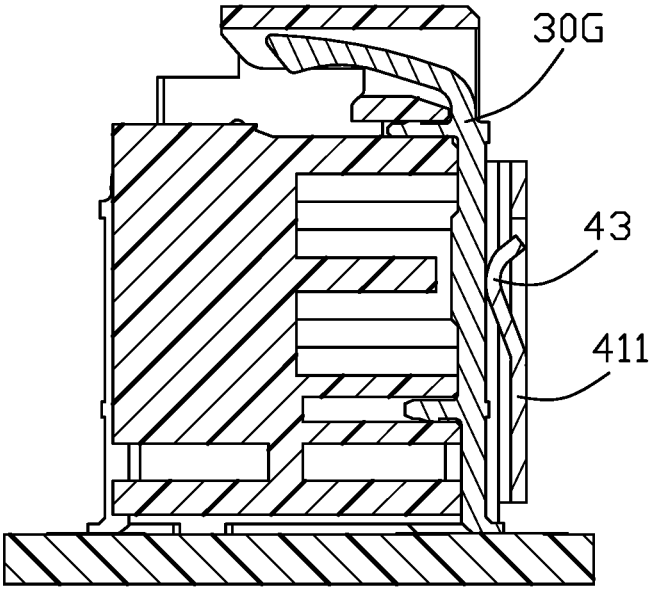
FIG. 21 is a cross-sectional view of the card edge connector taken along line 21-21 in FIG. 18.
Figure 22:
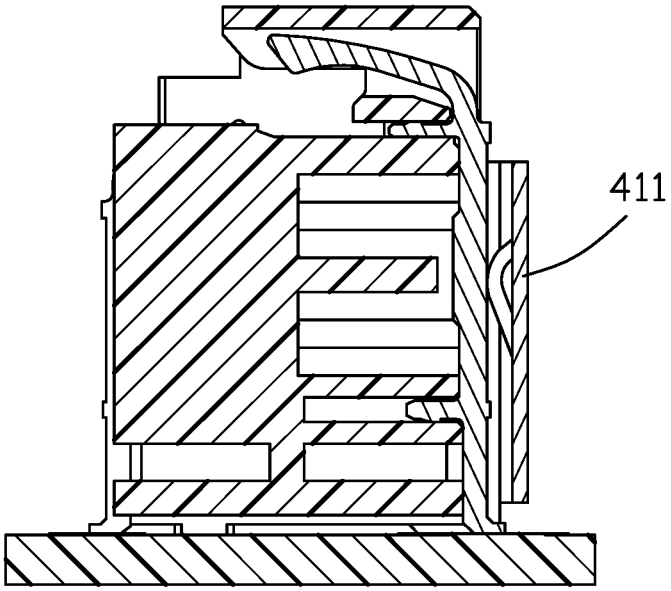
FIG. 22 is a cross-sectional view of the card edge connector taken along line 22-22 in FIG. 18.
Figure 23:
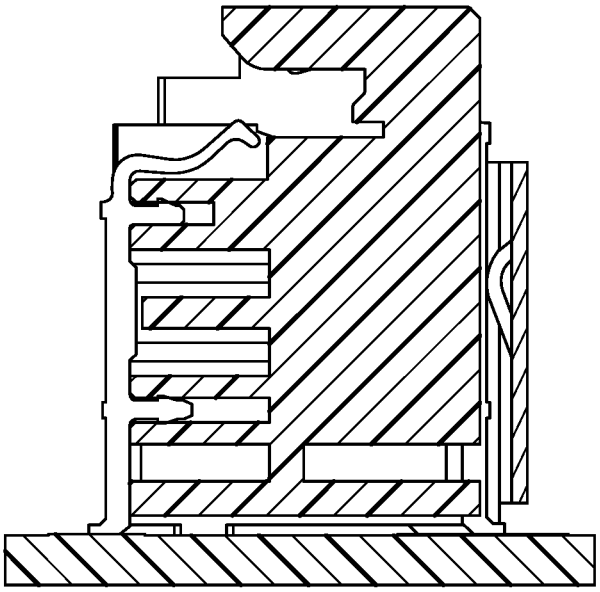
FIG. 23 is a cross-sectional view of the card edge connector taken along line 23-23 in FIG. 18.
Figure 24:
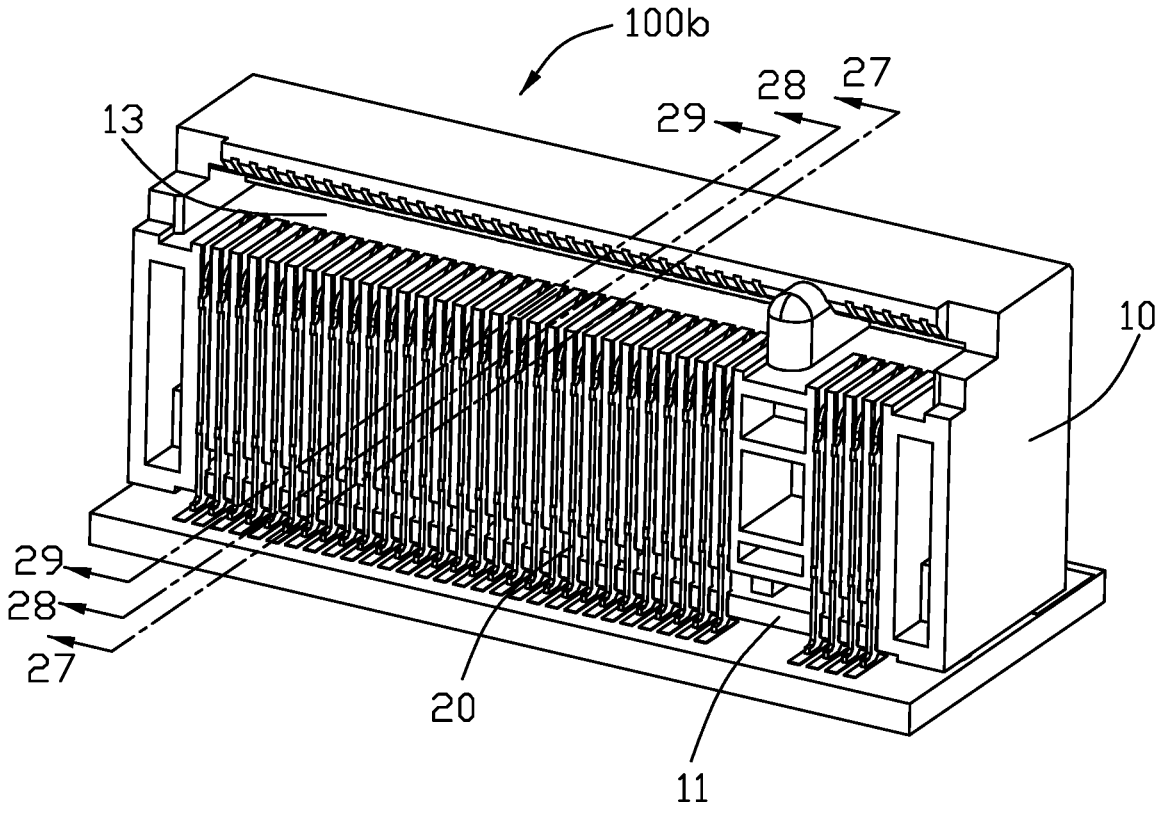
FIG. 24 is a perspective view of a card edge connector of fifth embodiment in accordance with the present invention.
Figure 25:
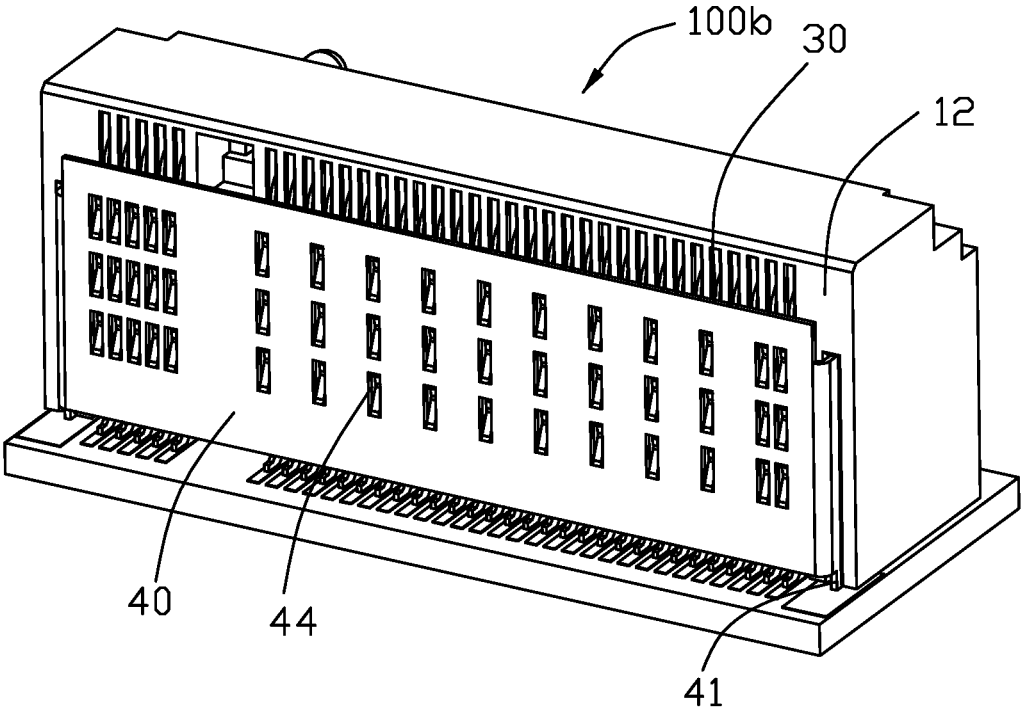
FIG. 25 is another perspective view of the card edge connector.
Figure 26:
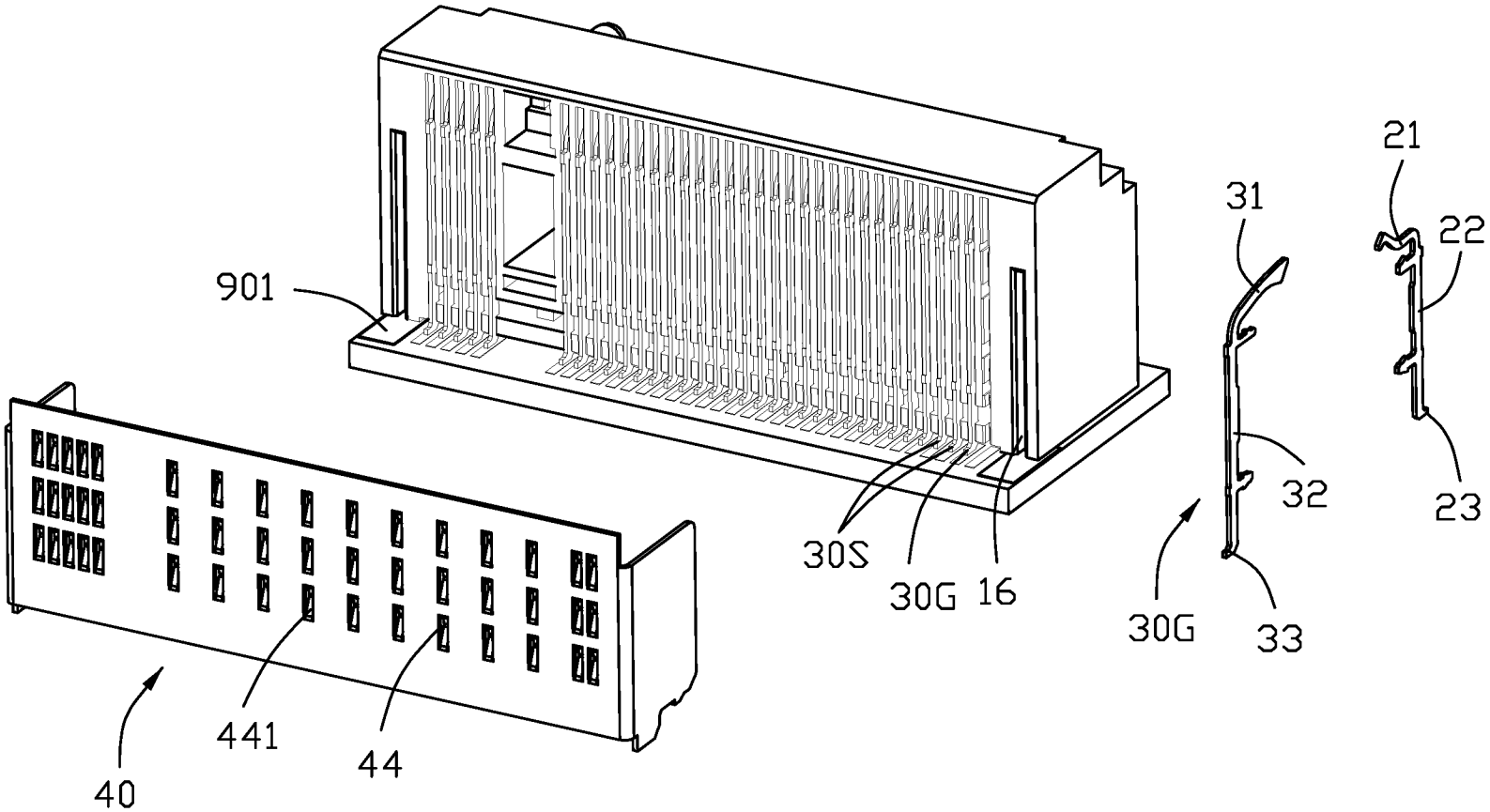
FIG. 26 is an exploded perspective view of the card edge connector.
Figure 27:
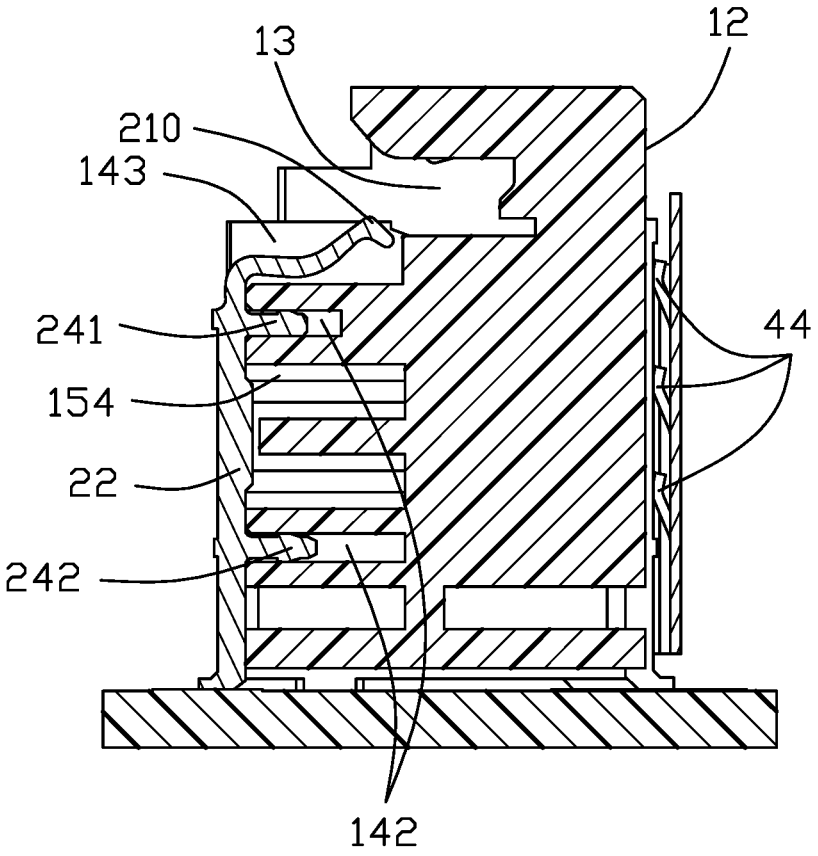
FIG. 27 is a cross-sectional view of the card edge connector taken along line 27-27 in FIG. 24.
Figure 28:
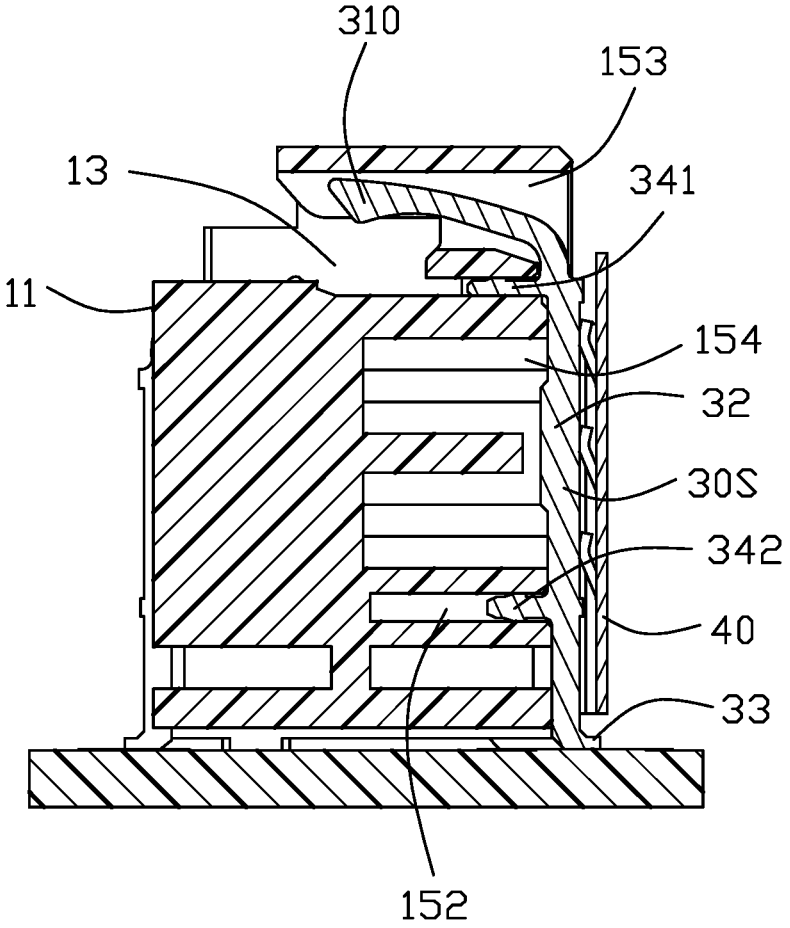
FIG. 28 is a cross-sectional view of the card edge connector taken along line 28-28 in FIG. 24.
Figure 29:
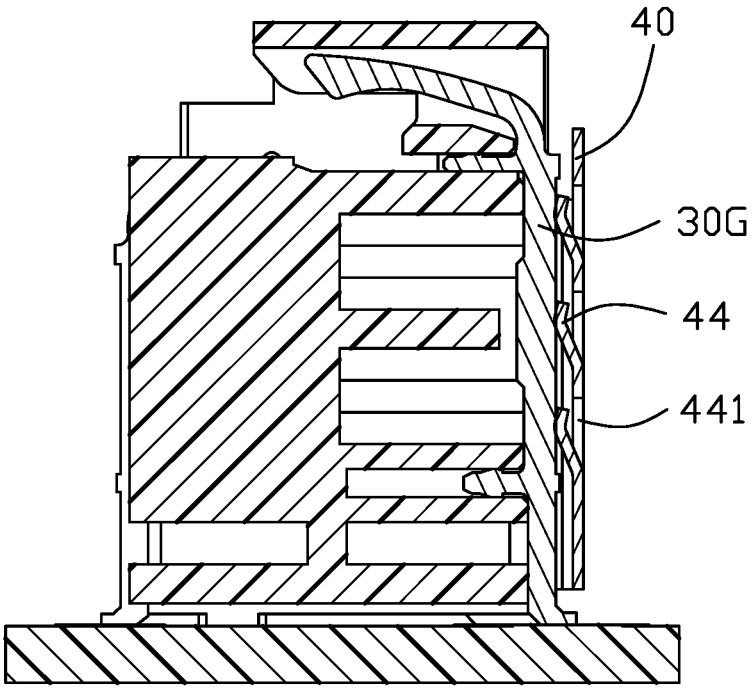
FIG. 29 is a cross-sectional view of the card edge connector taken along line 29-29 in FIG. 24.
Figure 30:
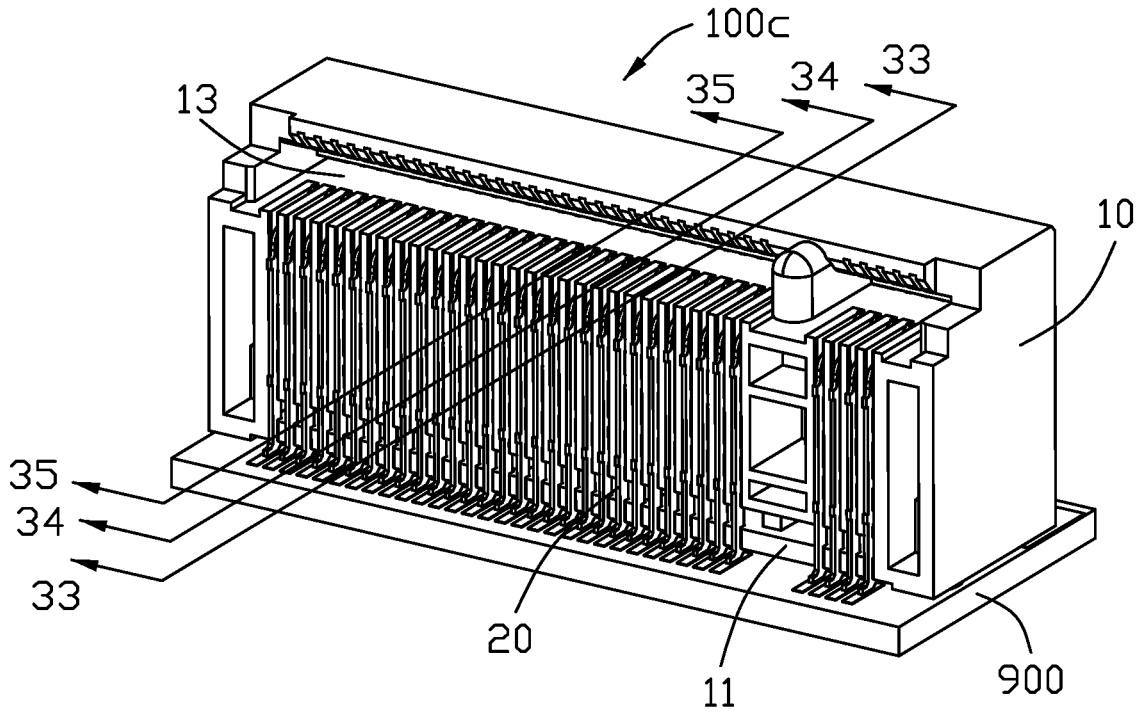
FIG. 30 is a perspective view of a card edge connector of sixth embodiment in accordance with the present invention.
Figure 31:
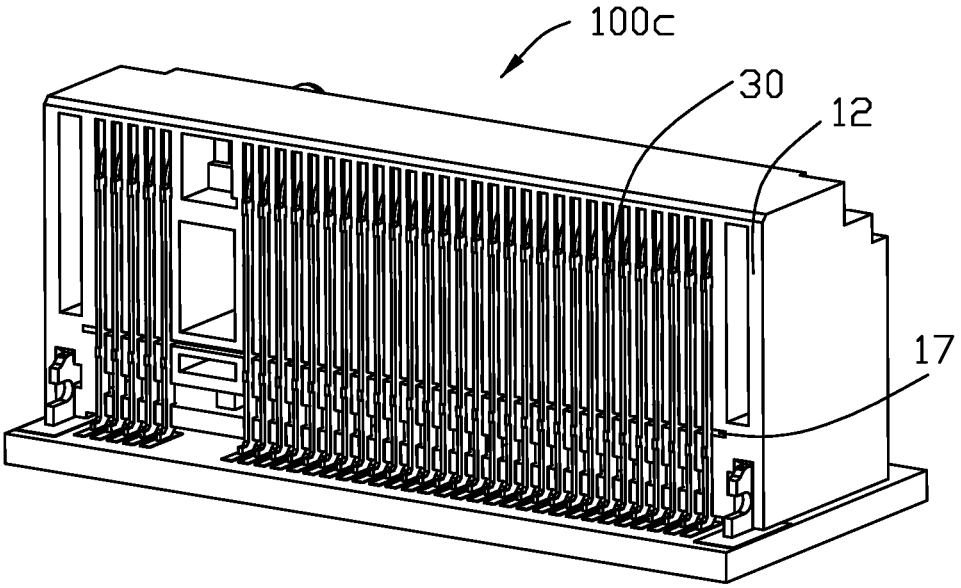
FIG. 31 is another perspective view of the card edge connector.
Figure 32:
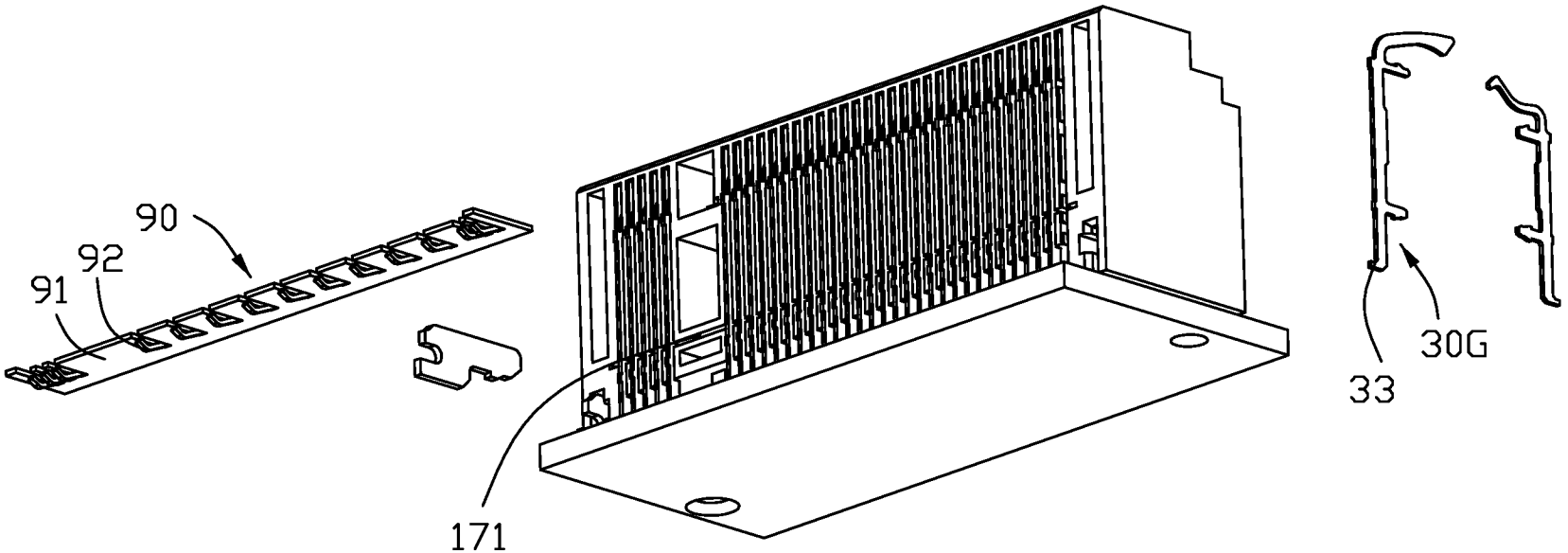
FIG. 32 is an exploded perspective view of the card edge connector.
Figure 33:
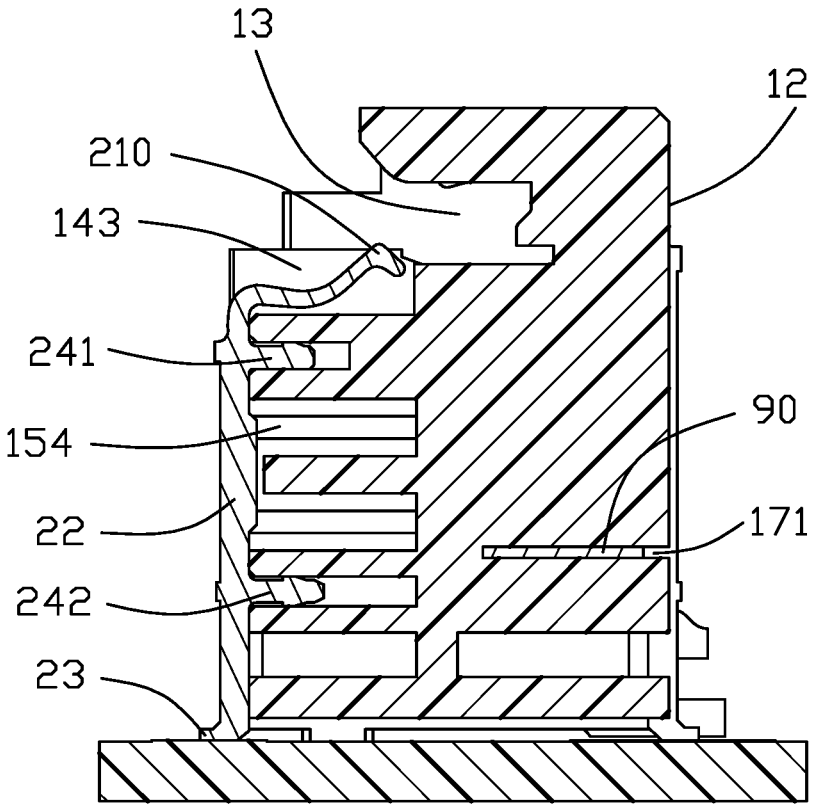
FIG. 33 is a cross-sectional view of the card edge connector taken along line 33-33 in FIG. 30.
Figure 34:
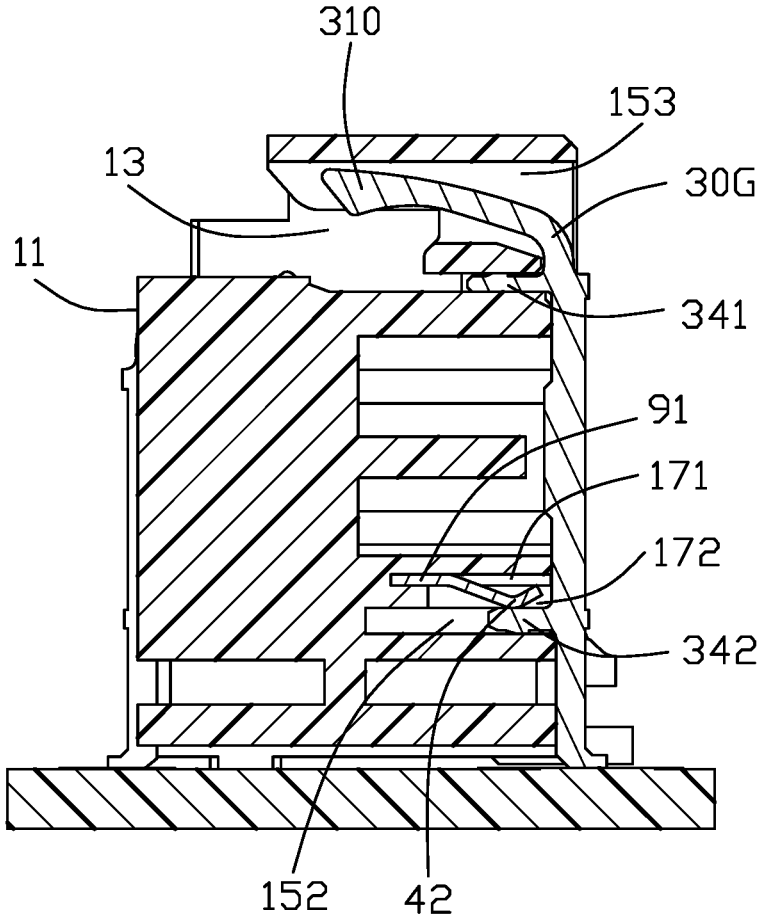
FIG. 34 is a cross-sectional view of the card edge connector taken along line 34-34 in FIG. 30.
Figure 35:
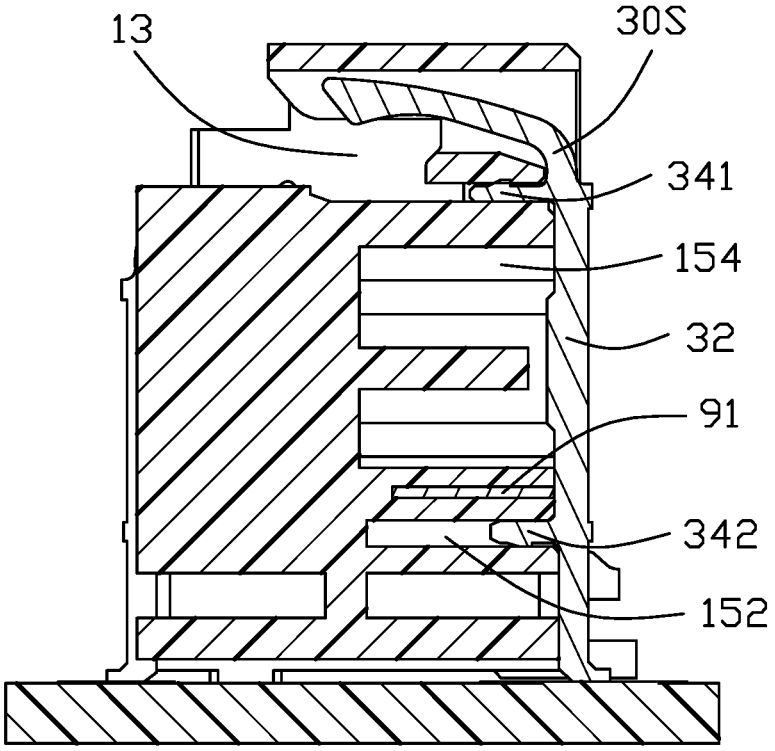
FIG. 35 is a cross-sectional view of the card edge connector taken along line 35-35 in FIG. 30.

FIGS. 13 and 17 illustrate a card edge connector 200*a* of a third embodiment. The connector 300 is DDR SO-DIMM socket and similar to the second embodiment. Note that same elements are labeled with same numerals and only the main difference is given hereinafter. The grounding terminals 60G define no grounding fingers, the grounding plate 40 includes a main plate 411 and two end plates 412, a row of grounding fingers 42 are punched from the main plate 411 and touch the grounding terminal 60G The grounding fingers 42 slant forward and upward with an arc free end. The arc free end press against the rear edge of the upright portion 640 of the grounding terminals 60G.

FIGS. 18 through 23 illustrate a card edge connector 100*a* of a forth embodiment. The connector 400 is M.2 socket and similar to the first embodiment. The grounding terminals

30G define no grounding arms, a row of grounding fingers 43 are punched from the main plate 411 and touch the grounding terminal 30G The grounding fingers 43 slant forward and upward with an arc free end. The arc free end press against the rear edge of the upright portion of the grounding terminals 30G.

FIGS. 24 through 29, illustrating a card edge connector 100*b* of a fifth embodiment, show a grounding and shielding plate 40 with three rows of grounding fingers 441. Three grounding fingers 44 on a same column touch one same grounding terminals 30G at three points along the upper and lower direction. The shielding plate 40 is a one-piece metal plate, each grounding finger extends from a lower inner side of a small window 441 defined on the shielding plate 40.

FIGS. 30 through 35 illustrate a card edge connector 100*c* of a sixth embodiment. The insulative housing 10 defines a longitudinal slot 171 recessed forward from the rear face 12 thereof and a plurality of receiving slots 172 underneath the longitudinal slot 171. The grounding plate 90 is a one-piece metal plate and includes a horizontal plate 91 and a plurality of grounding fingers 92 extending downwards from a front edge of small windows defined on the horizontal plate 91. The grounding plate 90 is located in the longitudinal slot 171 and the grounding fingers 92 run through the receiving slots 172 and touch the second/lower ribs 152. The grounding plate 90 is located in front of the upright portion.

However, the disclosure is illustrative only, changes may be made in detail, especially in matter of shape, size, and arrangement of parts within the principles of the invention.

What is claimed is:

1. A card edge connector comprising:

an insulative housing defining a front face, a rear face, and a card slot opening forward through the front face;

a row of first terminals retained in the insulative housing from the front face;

a row of second terminals retained in the insulative housing from the rear face and comprising signal terminals and grounding terminals, each second terminal comprising an upright portion, an elastic portion extending from the upright portion with a contacting portion exposed upon the card slot, and a leg portion; and a grounding and shielding plate;

wherein the grounding and shielding plate covers the rear face of the insulative housing and electrically connects to all the grounding terminals of the row of second terminals;

wherein an upper rib and a lower rib extend forward from the upright portion and are interference fit to the insulative housing; and wherein a grounding finger extends from a point between the upper rib and the lower rib of the upright portion of each grounding terminal and touches the grounding and shielding plate.

2. The card edge connector as claimed in claim 1, wherein the grounding finger slants upwards from a rear edge of the upright portion, and the upper and lower ribs extend from a front edge of the upright portion.

3. The card edge connector as claimed in claim 1, wherein the shielding and grounding plate extends upwards and adjacent to the upper ribs, extends downwards and adjacent to the lower ribs, and covers the whole row of second terminals along a transverse direction.

4. A card edge connector comprising:

an insulative housing defining a front face and a rear face and a card slot opening forward through the front face;

a row of first terminals retained in the insulative housing adjacent to the front face;

a row of second terminals retained in the insulative housing adjacent to the rear face and comprising signal terminals and grounding terminals, each second terminal comprising an upright portion with an upper rib and a lower rib forwardly extending to interference fit with the insulative housing, an elastic portion extending from the upright portion with a contacting portion exposed upon the card slot, and a leg portion; and a grounding plate retained in the insulative housing;

wherein the grounding plate is located in front of the upright portions of the second terminals and defines a plurality of grounding fingers pressing against the lower ribs.

* * * * *